US012618185B2

(12) United States Patent
Roetker

(10) Patent No.: US 12,618,185 B2
(45) Date of Patent: May 5, 2026

(54) METHOD FOR CONTROLLING AN AGITATION CYCLE IN A WASHING MACHINE

(71) Applicant: Haier US Appliance Solutions, Inc., Wilmington, DE (US)

(72) Inventor: John Joseph Roetker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 266 days.

(21) Appl. No.: 18/456,268

(22) Filed: Aug. 25, 2023

(65) Prior Publication Data

US 2025/0066977 A1 Feb. 27, 2025

(51) Int. Cl.

| | |
|---|---|
| ***D06F 34/28*** | (2020.01) |
| *D06F 33/32* | (2020.01) |
| *D06F 101/20* | (2020.01) |

(52) U.S. Cl.

CPC ..... *D06F 34/28* (2020.02); *D06F 33/32* (2020.02); *D06F 2101/20* (2020.02)

(58) Field of Classification Search

CPC ..... D06F 34/28; D06F 33/32; D06F 2101/00
See application file for complete search history.

(56) References Cited

U.S. PATENT DOCUMENTS

| | | | | |
|---|---|---|---|---|
| 7,565,822 | B2 | 7/2009 | Park et al. | |
| 7,797,969 | B2 | 9/2010 | Park et al. | |
| 9,416,480 | B2 | 8/2016 | Park et al. | |
| 2007/0094812 | A1* | 5/2007 | Watkins | D06F 35/006 68/12.24 |
| 2008/0312773 | A1* | 12/2008 | Nag | A47L 15/4293 700/275 |
| 2013/0271259 | A1* | 10/2013 | Brasseur | D06F 34/28 340/4.31 |
| 2023/0094292 | A1 | 3/2023 | Neves et al. | |

FOREIGN PATENT DOCUMENTS

| | | | | |
|---|---|---|---|---|
| KR | 20150118749 A | * | 10/2015 | D06F 34/05 |
| KR | 102352398 B1 | | 1/2022 | |

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

A washing machine appliance comprises a wash basket with an agitation device mounted within a wash tub, a motor mechanically coupled to the agitation device, and a control panel. A controller is configured to receive a user input selecting a target wash cycle from a plurality of wash cycles including a subset of modifiable wash cycles and a subset of fixed wash cycles, the target wash cycle including an agitation cycle profile, determine that the target wash cycle is a modifiable wash cycle, receive a user input selecting an agitation cycle modifier for adjusting an agitation cycle profile of the target wash cycle, and perform the target wash cycle with a modified agitation cycle profile as modified by the agitation cycle modifier.

18 Claims, 7 Drawing Sheets

METHOD FOR CONTROLLING AN AGITATION CYCLE IN A WASHING MACHINE

FIELD OF THE INVENTION

The present disclosure relates generally to washing machine appliances, more specifically to methods of operating the agitation cycle in a washing machine.

BACKGROUND OF THE INVENTION

Washing machine appliances generally include a cabinet that receives a tub for containing wash and rinse water, and a wash basket rotatably mounted within the tub. At various stages of a wash cycle, the wash basket agitates a load of laundry articles received therein. The agitation adds mechanical energy to the laundry load and causes interfacial scrubbing of the laundry articles that is useful in removing stains and particulate matter from the articles.

Recently, the interfacial scrubbing has been associated with microfiber abrasion and release of microfibers to the laundry effluent. Efforts have been made to reduce the release of microfibers to the environment in the wastewater system. One method is to reduce the abrasion in washing machines by reducing the energy added to laundry articles in the agitating the wash basket. However, some laundry loads of soiled articles require energetic agitation in order to be adequately cleaned. Accordingly, a laundry agitation cycle which prevents the transmission of microfibers into the wastewater system without hampering the laundry process would be beneficial.

BRIEF DESCRIPTION OF THE INVENTION

Aspects and advantages of the invention will be set forth in part in the following description, may be apparent from the description, or may be learned through practice of the invention.

In one exemplary aspect a washing machine appliance is disclosed, the washing machine appliance comprises a wash basket mounted within a wash tub, the wash basket defining a wash chamber, an agitation device positioned in the wash chamber, a motor mechanically coupled to the agitation device, a control panel, and a controller operably coupled to the motor and the control panel. The controller is configured to receive a user input selecting a target wash cycle from a plurality of wash cycles including a subset of modifiable wash cycles and a subset of fixed wash cycles, the target wash cycle including an agitation cycle profile. The controller is further configured to determine that the target wash cycle is a modifiable wash cycle, receive a user input selecting an agitation cycle modifier for adjusting an agitation cycle profile of the target wash cycle, and perform the target wash cycle with a modified agitation cycle profile as modified by the agitation cycle modifier.

In another exemplary aspect a method of operating a washing machine appliance is disclosed. The washing machine comprises a wash basket mounted within a wash tub, the wash basket defining a wash chamber, an agitation device positioned in the wash chamber, a motor mechanically coupled to the agitation device, a control panel, and a controller operably coupled to the motor and the control panel. The method comprises receiving a user input selecting a target wash cycle from a plurality of wash cycles including a subset of modifiable wash cycles and a subset of fixed wash cycles, the target wash cycle including an agitation cycle profile. The method further comprises determining that the target wash cycle is a modifiable wash cycle, receiving a user input selecting an agitation cycle modifier for adjusting an agitation cycle profile of the target wash cycle, and performing the target wash cycle with a modified agitation cycle profile as modified by the agitation cycle modifier.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
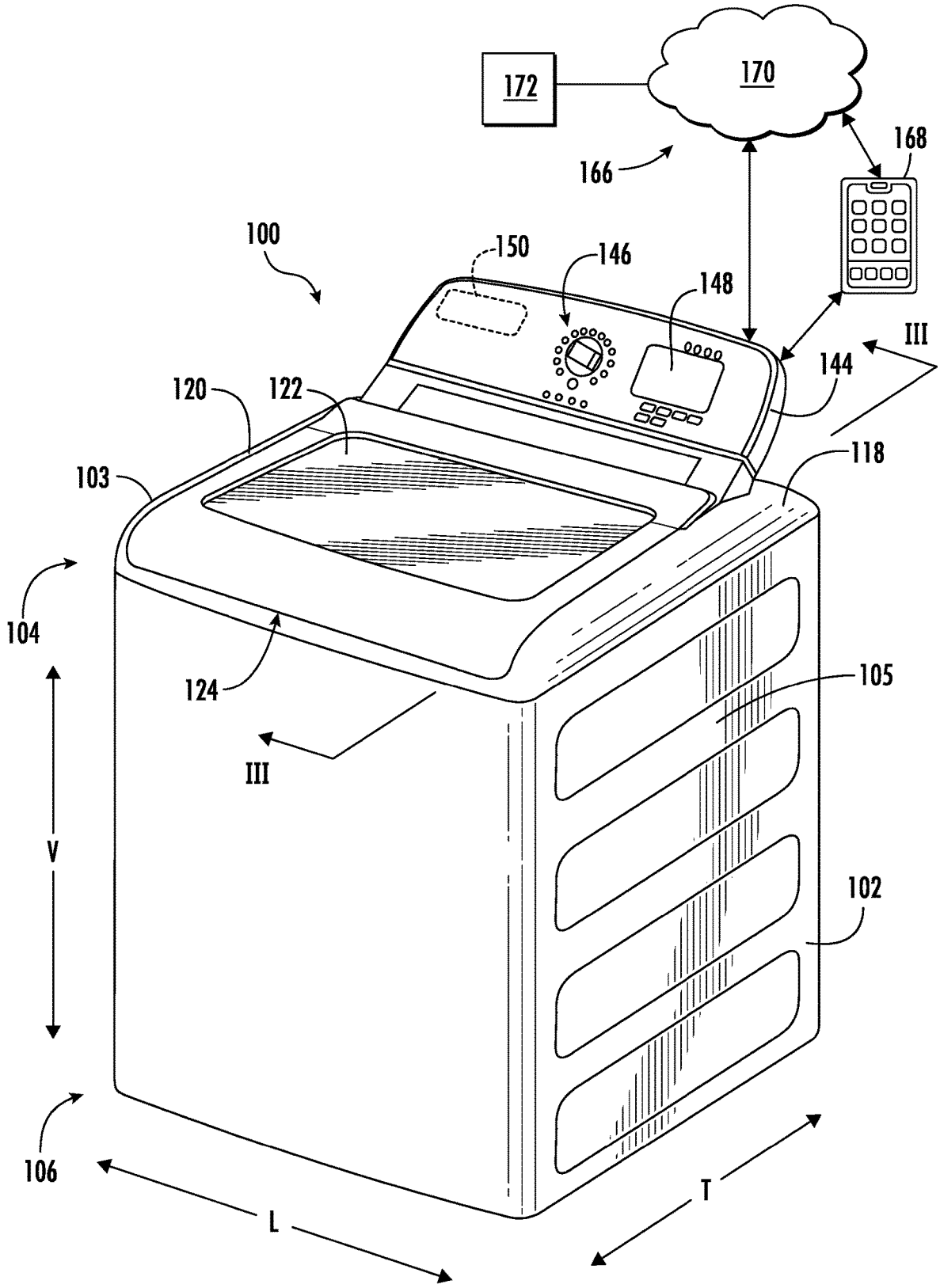
FIG. 1 provides a front perspective view of a laundry appliance with the door closed in accordance with an embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
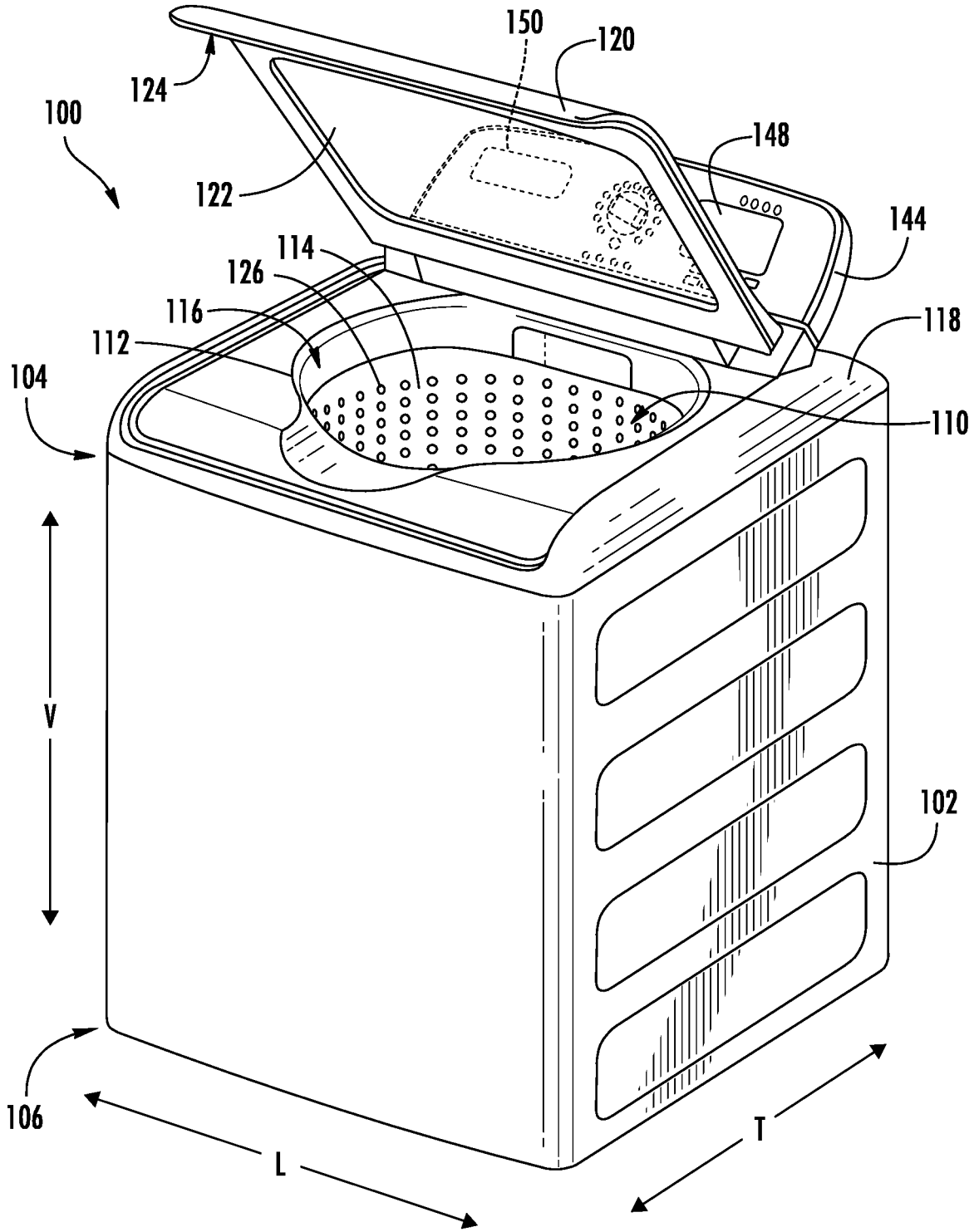
FIG. 2 provides a front perspective view of the laundry appliance of FIG. 1 with the door open.
Figure 3:
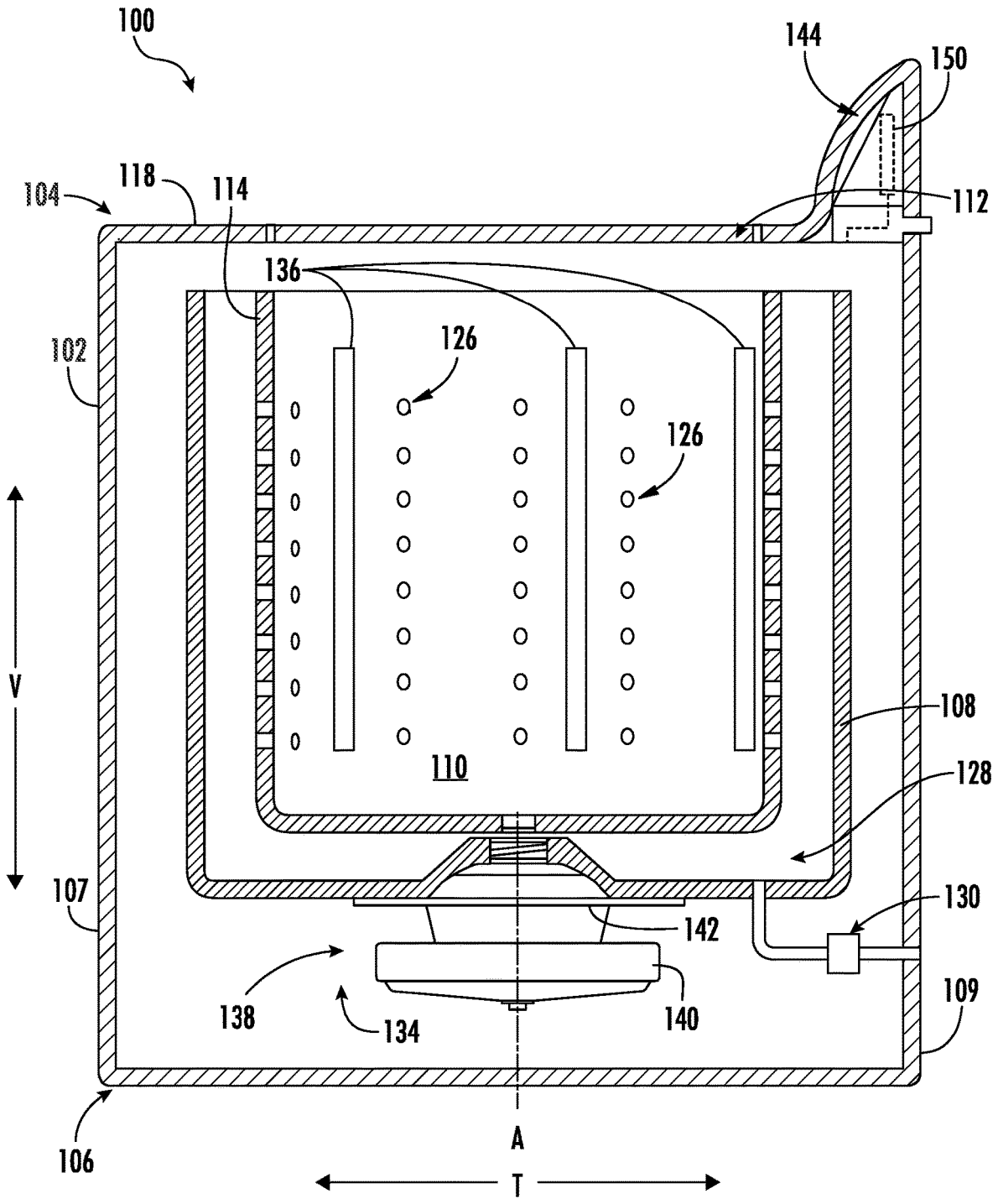
FIG. 3 provides a side sectional view taken along III-III of the laundry appliance of FIG. 1.

Turning to the figures, FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While embodiments of the present disclosure may be described in reference to a vertical axis (or top loading) washing machine appliance 100, it should be appreciated that vertical axis washing machine appliance 100 is provided by way of example only. It will be understood that aspects of the present subject matter may be used in any other suitable washing machine appliance, such as a horizontal axis (front loading) washing machine appliance. As will be generally understood by one of ordinary skill in the art, modifications and variations may be made to vertical axis washing machine appliance 100, including different configurations, different appearances, or different features while remaining within the scope of the present disclosure.

Figure 4:
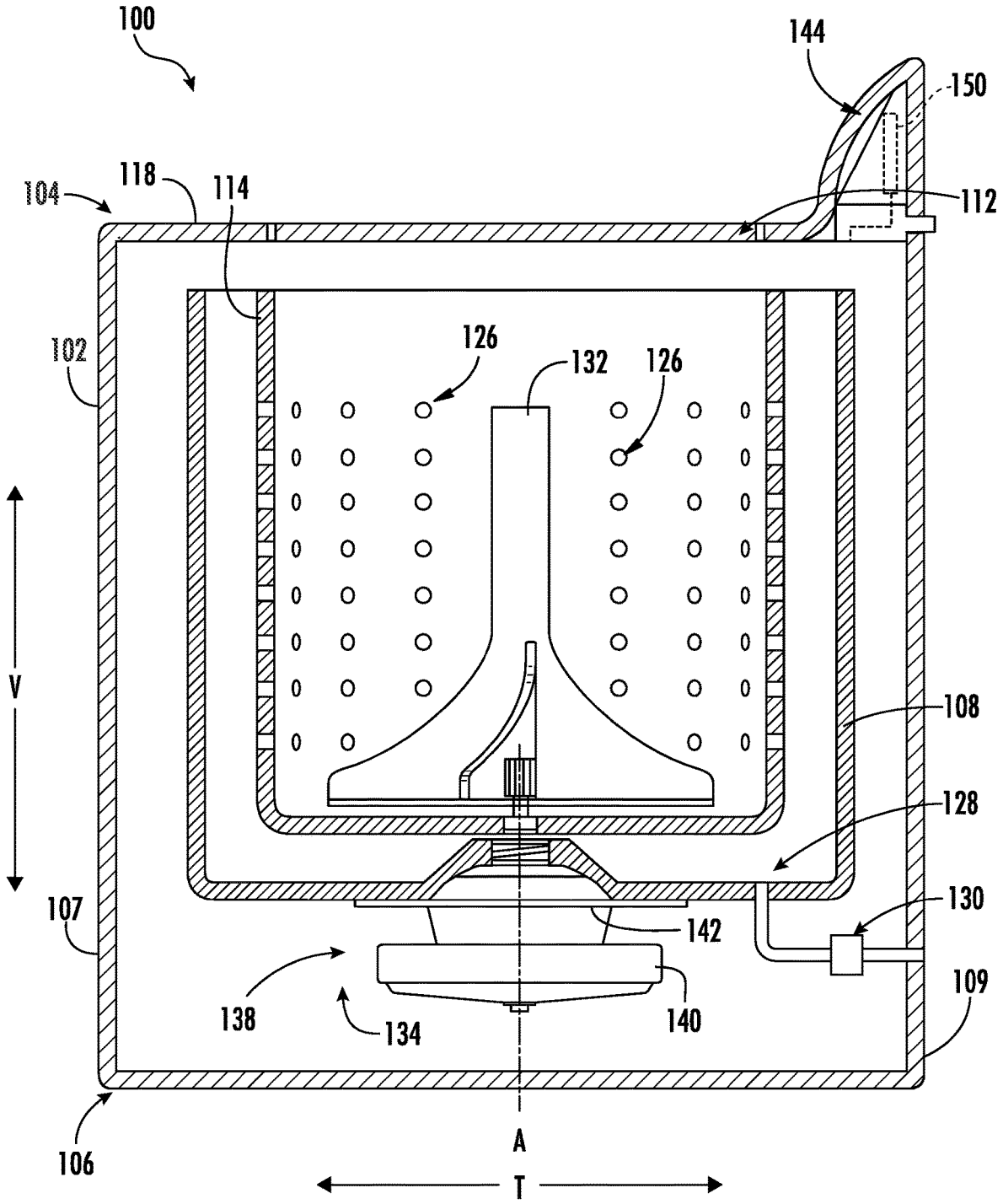
FIG. 4 provides a side sectional view taken along III-III of an alternate embodiment of the laundry appliance of FIG. 1.

As illustrated in the figures, washing machine appliance 100 comprises a cabinet 102 that extends between a top portion 104 and a bottom portion 106 along the vertical direction V, between a first (left) side panel 103 and a second (right) side panel 105 along the lateral direction L, and between a front panel 107 and a rear panel 109 along the transverse direction T. As best shown in FIGS. 3 and 4, a wash tub 108 is positioned within cabinet 102, the wash tub 108 defining a wash chamber 110, and generally configured for retaining wash fluids during an operating cycle.

Further, washing machine appliance 100 includes a wash basket 114 positioned within wash tub 108 and generally defining a wash chamber 110, having an opening 116, configured for receiving a laundry articles for washing. Wash basket 114 is supported within wash tub 108 for rotation about an axis of rotation A. According to the illustrated embodiment, the axis of rotation A is substantially parallel to the vertical direction V and runs through the center of the wash tub 108 and wash basket 114. In this regard, washing machine appliance 100 is generally referred to as a "vertical axis" or "top load" washing machine appliance 100. However, it should be appreciated that aspects of the present subject matter may be used within the context of a horizontal axis, or front load, washing machine appliance as well.

As illustrated, cabinet 102 of washing machine appliance 100 has a top panel 118 which defines a top panel opening 112 (FIG. 2) that coincides with opening 116 of wash basket 114 to permit a user access to wash basket 114. Washing machine appliance 100 further includes a lid 120 which is rotatably mounted to top panel 118 to permit selective access to wash basket 114 through opening 116. Lid 120 selectively rotates between the closed position (FIG. 1) and the open position (FIG. 2). In the closed position, lid 120 blocks access to wash basket 114. Conversely, in the open position, a user can access wash basket 114. A window 122 in lid 120 may be provided to permit viewing of wash basket 114 when lid 120 is in the closed position, for example, during operation of washing machine appliance 100. Lid 120 may also include a handle 124 that may facilitate opening and closing lid 120. Further, although lid 120 is illustrated as mounted to top panel 118, lid 120 may alternatively be mounted to cabinet 102 or any other suitable support.

As illustrated in FIGS. 2 through 4, wash basket 114 further defines a plurality of perforations 126 to facilitate fluid communication between an interior of wash basket 114 and wash tub 108. For at least this purpose, wash basket 114 is spaced apart from wash tub 108 to define a space for wash fluid to escape wash chamber 110. During a spin cycle, wash fluid within articles of clothing and within wash chamber 110 is urged through perforations 126 and may collect in a sump 128 defined between the lower portions of wash basket 114 and wash tub 108. Washing machine appliance 100 may further include a pump assembly 130 (FIG. 3) that is located beneath wash tub 108 and wash basket 114 for gravity assisted flow when draining wash tub 108.

In some embodiments, one or more agitation devices, for example ribs 136, extend from the wash basket 114 into the wash chamber 110 to interact with laundry articles placed in the wash basket 114 (FIG. 3). More specifically, the ribs 136 assist in the agitation of the laundry articles in the wash fluid contained in the wash basket 114. As the wash basket 114 rotates (i.e., in a cycle of clockwise and counterclockwise rotations about axis A), the ribs 136 agitate the water and the laundry articles, providing a mechanical action to facilitate cleaning of the articles. The clockwise and counterclockwise rotations of the wash basket 114 may be separated by a rest or dwell period with no driven motion of the wash basket 114. The motion of the laundry articles results in interfacial scrubbing of the articles (i.e., abrasion of the laundry article material against itself or against other laundry articles) which may be useful in cleaning some types of stained laundry articles, for example particulate stains such as dirt. The interfacial scrubbing (e.g., during agitation) releases some of the stains in the laundry articles and the wash fluid transports the stain material away from the laundry articles (e.g., during the dwell period).

In an alternate embodiment, an impeller or agitation device, such as a vane agitator 132 (FIG. 4), may be disposed in wash basket 114 to impart an oscillatory motion to laundry articles and liquid in wash basket 114. More specifically, agitator 132 extends into wash basket 114 and motor assembly 138 imparts a series or cycles of clockwise and counterclockwise rotation to the agitator 132 and/or the wash basket 114. Clockwise and counterclockwise rotations may be separated by rest or dwell periods with no driven motion of the agitator 132. The clockwise and counterclockwise rotation facilitates agitation of articles disposed within wash basket 114 during operation of washing machine appliance 100 to, for example, facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). One or more dwell periods may separate the various agitator actions. As above, the action of the agitator 132 facilitates removal of some stains from the laundry articles and the stain material may be transported away from the article during the dwell periods. As illustrated in FIG. 3, agitator 132 and wash basket 114 are oriented to rotate about axis of rotation A, which is substantially parallel to vertical direction V and centrally located in wash tub 108.

In another embodiment, the axis of rotation A may be parallel to the transverse direction T as in a front loading washing machine appliance (not shown). A front loading washing machine appliance operates on the same principles as discussed above, particularly closely adhering to the operation as described with reference to FIG. 3. Notably, in a front loading washing machine appliance, ribs lift and drop the laundry articles as the laundry basket rotates about a horizontal axis. The lifting and dropping occurs in the presence of wash fluid accumulated in the bottom of the wash basket, imparting interfacial scrubbing between article surfaces as described above. Dwell periods may separate periods of agitation brought about by rotation of the wash basket about a horizontal axis. As above, the rotation or agitation periods may separate stain material from the laundry article and the stain material may be transported away in a wash liquid during dwell periods.

As illustrated in FIGS. 3 and 4, washing machine appliance 100 includes a motor assembly 138 in mechanical communication with wash basket 114 and agitator 132 (if present) to selectively rotate wash basket 114, the agitator 132, or both the wash basket 114 and the agitator 132, for example during an agitation cycle or a rinse cycle of washing machine appliance 100. In this manner, motor assembly 138 may be configured for selectively rotating or oscillating wash basket 114 and/or agitator 132 during various operating cycles of washing machine appliance 100.

Motor assembly 138 may generally include one or more of a drive motor 140 and a transmission assembly 142, for example a clutch assembly for engaging and disengaging wash basket 114 and/or agitator 132 with the drive motor 140. The drive motor 140 may be a brushless DC electric motor, e.g., a pancake motor as illustrated. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Generally, the motor assembly 138 is fixed to the wash tub 108 with appropriate sealing elements (not shown) to achieve a watertight seal to contain wash fluid in the wash tub 108. In many cases, the wash tub 108, the wash basket 114, the agitator 132, and the motor assembly 138 are collectively referred to as a subwasher assembly 134. In the present embodiment, subwasher 134 comprises the wash tub 108, the wash basket 114 mounted in the tub 108 and defining wash chamber 110 for receiving a load of laundry articles, an agitation device (for example vane agitator 132 or ribs 136), and a motor 140 mechanically coupled to the agitation device 132.

Operation of washing machine appliance 100 is controlled by a controller 150 that is operatively coupled (e.g., electrically coupled or connected) to at least the motor assembly 138 and at least one user input selector 146 located on control panel 144 or at display screen 148 (FIGS. 1 and 5) for user manipulation to select washing machine cycles, modifications, and features. In embodiments, the control panel 144 includes more than one input selector 146. Control panel 144, input selector 146, and display 148 collectively form a user interface input for operator selection of machine cycles and features. In response to user manipulation of the user input selector 146, controller 150 operates the various components of washing machine appliance 100 to execute selected machine cycles and features. A display 148 on control panel 144 indicates selected features, operation mode, a countdown timer, and/or other items of interest to appliance users regarding operation. Display 148 may include an input selector 146, for example a selectively displayed agitation modification selector 164, including a status indicator 165. In embodiments, selector 164 and status indicator 165 may be included in a touch sensitive portion of display 148. In addition to the visual display 148, control panel 144 may also include auditory signaling devices, such as a speaker.

Figure 5:
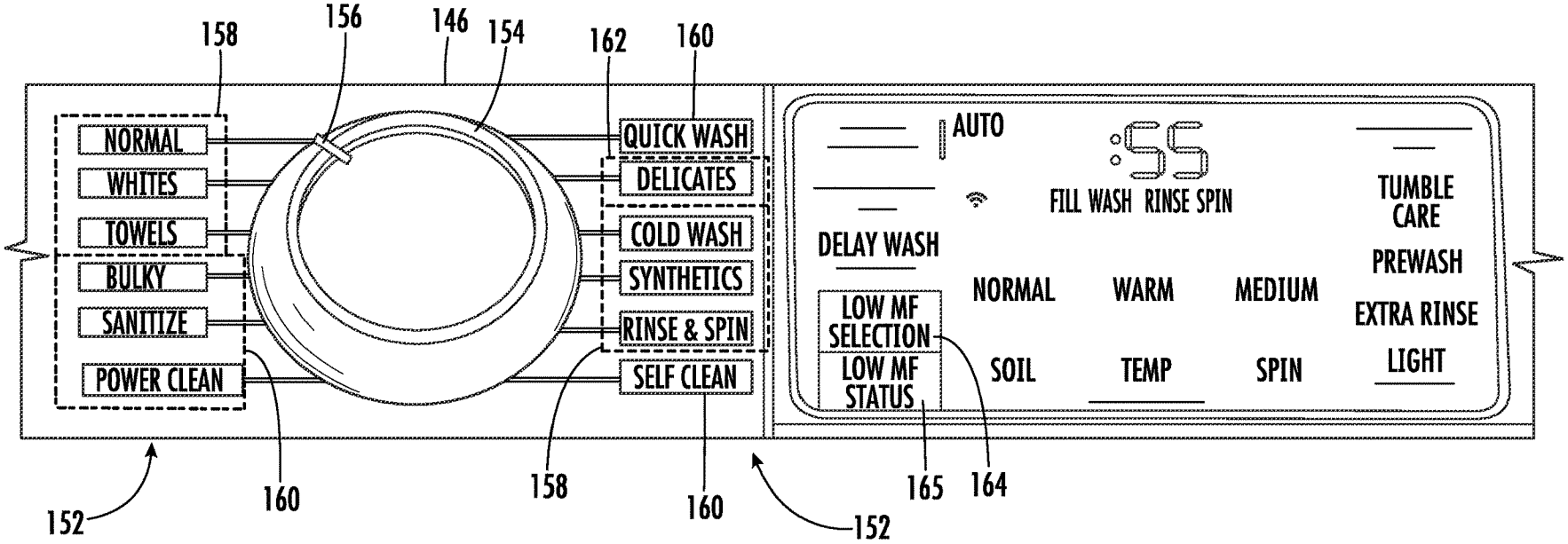
FIG. 5 provides an enlarged view of a portion of the control panel of FIG. 1.

According to the illustrative embodiment of FIG. 5, control panel 144 may include an input selector 146, for example a rotary dial selector 154, to receive and accept user input to allow a user to select a target wash cycle from a plurality of wash cycles 152 through user manipulation of the input selector 146. A user may rotate the rotary dial selector 154 until the indicator 156 is aligned with the desired or target wash cycle (as illustrated the "normal" cycle). The plurality of wash cycles 152 may include subsets based on wash cycle characteristics or other criteria. For example, one subset may be a subset of modifiable or eligible (i.e., eligible to be modified) wash cycles 158, another may be a subset of fixed wash cycles 160 which may not be modified, or another may be a subset of required wash cycles 162 which include the modified profile as an essential and permanent feature of the wash cycle. As illustrated, normal, whites, towels, cold wash, synthetics, and rinse and spin wash cycles may be included in the subset of modifiable wash cycles 158. Alternatively, bulky, sanitize, power clean, quick wash, and self-clean wash cycles cannot be modified and may be included in the subset of fixed wash cycles 160. The delicates wash cycle may be included in the subset of required wash cycles 162. The classification in the illustrative example of FIG. 5 is provided as an example and not a limitation. Other subsets of wash cycles may be provided in other embodiments. In embodiments, the plurality of wash cycles 152 may include more or fewer wash cycles and the plurality of wash cycles may be grouped into different subsets.

In some embodiments, the control panel 144 comprises a screen 148 including user input, selector 164, that the controller 144 causes to be visually displayed when a modifiable target wash cycle (i.e., a target wash cycle in a subset of modifiable cycles) is selected. Display of the input selector 164 is blocked at the display screen 148 in response to a user input selecting a target wash cycle that is included in the subset of fixed or subset of required wash cycles. When displayed, selector 164 at display screen 148 may be manipulated by a user to select an agitation cycle modifier for the target wash cycle. The selector 164 is in operational communication with the controller 144 to receive the user input. When selector 164 is manipulated to receive user input of an elected agitation cycle modifier, status indicator 165 my signal, for example by illuminating, the user input has been received.

Wash cycles include one or more agitation profiles which are predetermined agitation cycles including a first rotation period for the agitation devices (e.g., agitator 132 or ribs 136) in a first direction at a predetermined speed and for a predetermined duration (i.e., time period), a predetermined dwell time period, a second rotation period for the agitation device in a second direction at a predetermined speed and for a predetermined duration, and a second dwell time period. The wash cycle may include more than one agitation cycle, with subsequent agitation cycles directly following a dwell time of the previous cycle, or the wash cycle may perform other operations, such as rinse or spin operations, after a first agitation cycle and before a subsequent agitation cycle. Subsequent agitation cycles in a defined wash cycle may have the same agitation profile as the first agitation cycle. In some embodiments, a wash cycle may have different and varied agitation profiles, with agitation speed, direction, and time carrying from one agitation cycle to another.

Controller 150 may include a memory (e.g., non-transitory storage media) and microprocessor, such as a general or special purpose microprocessor operable to execute programming instructions or micro-control code associated with a washing operation or cycle. For example, controller 150 may store the individual wash characteristics (e.g., agitation profiles) for a plurality of wash cycles (e.g., 152 FIG. 5). The controller 150 may store, or save, the operating parameter for the plurality of wash cycles in the one or more predetermined subsets discussed above. The controller 150 may also store agitation cycle modifications to apply to one or more of the plurality of wash cycles in the modifiable subset. Each wash cycle may have a specific agitation cycle modifier to apply to the agitation cycle portion of the wash cycle. In other embodiments, one agitation cycle modifier may be applied to more than one wash cycle.

The memory may represent random access memory such as DRAM, or read only memory such as ROM or FLASH. In embodiments, the controller 150 executes programming instructions stored in memory (e.g., as software). The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 144 and other components of washing machine appliance 100 (such as the drive motor 140 and the transmission assembly 142) may be in operative communication with controller 150 via one or more signal lines or shared communication busses to provide signals to and/or receive signals from the controller 150. For example, the controller 150 may communicate with the motor assembly 138 to selectively rotate the wash basket 114 or agitator 132 at various speeds, directions of rotation, or durations of rotation in the course of an agitation cycle portion of a wash cycle.

Referring back to FIG. 1, a schematic illustration of an external communication system 166 will be described according to an exemplary embodiment of the present subject matter. In general, external communication system 166 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 166 may be used to transfer data or other information to improve performance of one or more external devices or appliances and/or improve user interaction with such devices.

For example, external communication system 166 permits controller 150 of washing machine appliance 100 to communicate with a separate device external to washing machine appliance 100, referred to generally herein as an external device 168. As described in more detail below, these communications may be facilitated using a wired or wireless connection, such as via a network 170. In general, external device 168 may be any suitable device separate from washing machine appliance 100 that is configured to provide and/or receive communications, information, data, or commands from a user. In this regard, external device 168 may be, for example, a personal phone, a smartphone, a tablet, a laptop or personal computer, a wearable device, a smart home system, or another mobile or remote device.

In addition, a remote server 172 may be in communication with washing machine appliance 100 and/or external device 168 through network 170. In this regard, for example, remote server 172 may be a cloud-based server 172, and is thus located at a distant location, such as in a separate state, country, etc. According to an exemplary embodiment, external device 168 may communicate with a remote server 172 over network 170, such as the Internet, to transmit/receive data or information, provide user inputs, receive user notifications or instructions, interact with or control washing machine appliance 100, etc. In addition, external device 168 and remote server 172 may communicate with washing machine appliance 100 to communicate similar information.

In general, communication between washing machine appliance 100, external device 168, remote server 172, and/or other user devices or appliances may be carried using any type of wired or wireless connection and using any suitable type of communication network, non-limiting examples of which are provided below. For example, external device 168 may be in direct or indirect communication with washing machine appliance 100 through any suitable wired or wireless communication connections or interfaces, such as network 170. For example, network 170 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 166 is described herein according to an exemplary embodiment of the present subject matter. However, it should be appreciated that the exemplary functions and configurations of external communication system 166 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Now that the construction of laundry appliance 100 and the configuration of controller 150 according to exemplary embodiments have been presented, exemplary method 200 of operating a dryer appliance will be described with reference to FIG. 6. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 150 or a separate, dedicated controller.

Figure 6:
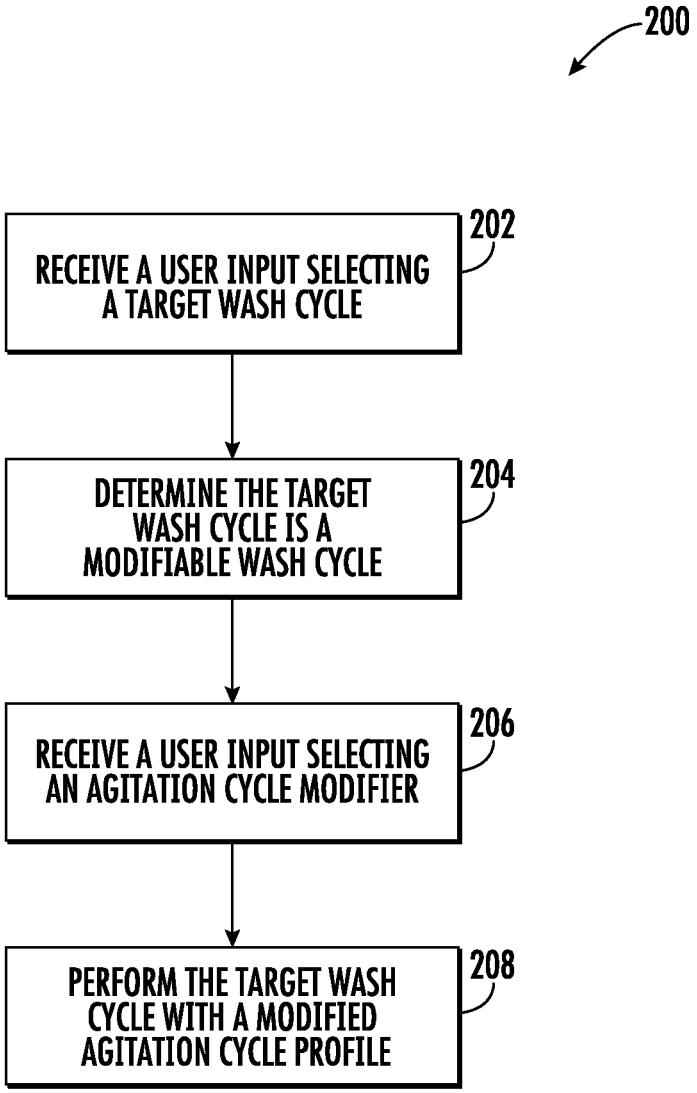
FIG. 6; illustrates a method for operating a washing machine appliance in accordance with one embodiment of the present disclosure.

Referring to FIG. 6, method 200 includes, at step 202, receiving at the controller 150 a user input selecting a target wash cycle. The target wash cycle may be selected from a plurality of wash cycles indicated at the washing machine appliance 100, for example at the control panel 144. The parameters for the various portions or cycles of each wash cycle may be stored in the controller 150. A user may select a target wash cycle using on or more user input selectors 146, such as dial selector 154.

The plurality of wash cycles 152 may comprise or be organized in subsets based on wash cycle characteristics, such as agitation profile. In an exemplary embodiment, wash cycles may include a subset of modifiable wash cycles and a subset of fixed or non-modifiable wash cycles. Modifiable wash cycles 158 include agitation profiles that are predetermined to accept, or be eligible for, optional, user-selected modifications to the agitation profile. Enacting an agitation cycle modifier is a user choice based on user preferences. Wash cycles that may not be eligible for modification to the agitation cycle, those in the fixed subset 160, include those cycles that require the predetermined agitation cycle to fulfill their purpose. They are predetermined to not accept an agitation cycle modifier because to do so would defeat the purpose and user expectations of the wash cycle. Other wash cycles may be included in the required subset 162 of wash cycles and include the modification as an essential feature of the cycle. Accordingly, adding an agitation cycle modifier would add no benefit and giving the user the option of removing the characteristics of the agitation cycle modifier would detract from the wash cycle and lead to user dissatisfaction.

At 204, the controller 150 evaluates the target wash cycle to determine the target wash cycle is a modifiable wash cycle, i.e., included in the modifiable subset 158 of wash cycles. The controller 150 may make use of a look-up chart or table to determine of the target wash cycle is included. The look-up table may be saved at a memory location of the controller 150 or may be accessible from the network 170 of the external communication system 166. Alternatively, parameters of the target wash cycle may be compared to a list of modifiable, or eligible to be modified, parameters saved to the controller or the network 170. If the target wash cycle parameters correspond with predetermined parameters, the target cycle may be considered included in the modifiable subset.

After determining that the target wash cycle is a modifiable was cycle in 204, the method advances to 206. At 206, the method receives a user input selecting an agitation cycle modifier for adjusting the agitation cycle profile of the target wash cycle. User input of an agitation cycle modifier is accepted only for target wash cycles in the subset of modifiable wash cycles 158. In some embodiments, the option for a user to input an agitation cycle modifier is not provided (i.e., the option does not appear on the display 148). In other embodiments, entering the agitation cycle modifier (for example on a mechanical input selector) is null or produces a null response from the controller 150. Upon receiving the agitation cycle modifier input at 206, the method advances to 208.

At 208, controller 150 provides instruction to the washing machine appliance 100 to perform the target wash cycle with a modified agitation cycle profile as modified by the agitation cycle modifier. The target wash cycle includes an agitation cycle profile comprising a first rotation of the agitation device (i.e., agitator 132 or ribs 136) in a first direction at a first speed and for a first duration of time. Following the first rotation, the agitation profile provides a first dwell time during which the is no agitation of the agitation device by the washing machine appliance 100. The dwell time may allow particulate matter released during the agitation to flow away from the laundry articles. Following the first dwell time, the agitation cycle continues with a second rotation of the agitation device in a second direction at a second speed and for a second duration of time. The first and second rotation directions, the first and second durations, first and second speeds, and first and second dwell times may be the same or may be different.

The first and second durations and the first and second dwell times have a temporal component, that is a time is associated with each. A typical un-modified wash cycle may have a first duration of about 12 seconds, a first dwell time of about 4 seconds, a second duration of about 12 seconds and a second dwell time of about 4 seconds. The total time (i.e., mathematical sum) of the first duration, the second duration, the first dwell time, and the second dwell time may be considered the cycle time. In this example the total cycle time is about 32 seconds. A duty cycle for the agitation cycle can be established by dividing the sum of the first and second durations (i.e. mathematical sum of the lengths of time for the first and second rotation durations) by the cycle time, with duty cycle often represented by a percentage. A typical duty cycle for an un-modified wash cycle (continuing with the example above) may be about 75%.

The agitation cycle modifier provided at 208 may modify or alter the target agitation cycle profile. In particular, the agitation cycle modifier may alter one or more of the first speed, the first rotation direction, the first duration, the first dwell time, the second speed, the second rotation direction, the second duration, and the second dwell time. In some embodiments, the agitation cycle modifier reduces the first speed and the second speed. In other embodiments, the cycle modifier reduces the first duration and the second duration. That is, when modified by the agitation cycle modifier, the agitation device rotates in the first and second direction for less time than in the agitation profile of the unmodified target wash cycle. In some embodiments, the first and second durations may be reduced by the same amount of time, while in other embodiments the time reduction in the durations may be different.

In some embodiments, the cycle modifier also increases the dwell time by an amount corresponding to the reduction of durations such that the total cycle time remains unchanged. In other words, the agitation cycle modifier reduces the first duration and the second duration by a total time reduction and increases the first dwell time and the second dwell time by a total time increase corresponding to the total time reduction. Notably, with a reduced duration, the duty cycle may be reduced. In continuing with the above example, reducing the first and second durations to about 8 seconds each from the unmodified 12 seconds, and increasing the first and second dwell times to about 8 seconds from the unmodified 4 seconds results in the same cycle time of about 32 seconds but a duty cycle of 50%. Accordingly, in some embodiments, the agitation cycle modifier may reduce one or more of the durations, increase one or more of the dwell times, and reduce the resulting duty cycle.

Figure 7:
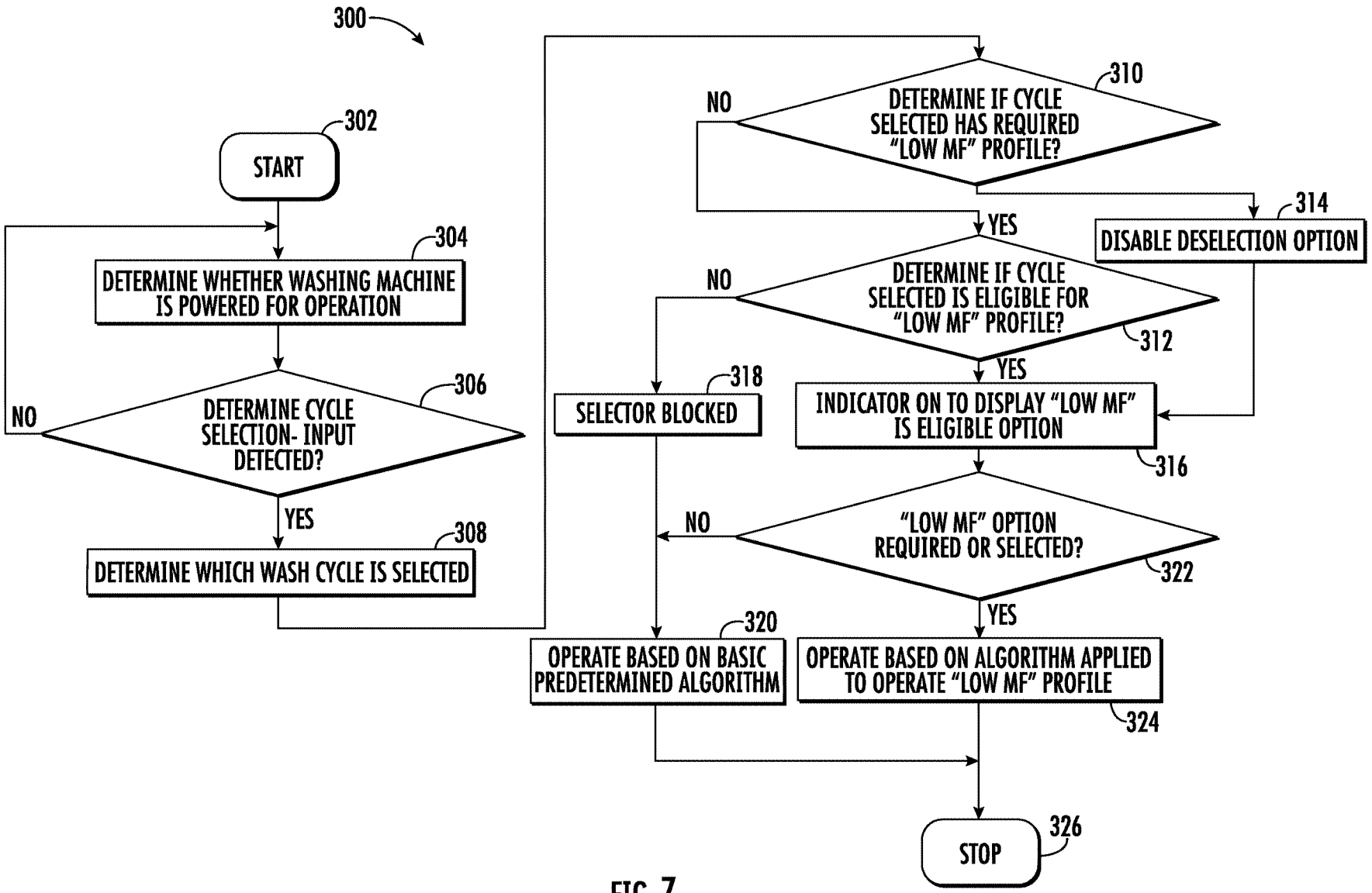
FIG. 7 provides a flow diagram of an exemplary process for implementing a an agitation cycle modifier in a washing machine appliance wash cycle in accordance with an exemplary embodiment of the present subject matter.

Referring now briefly to FIG. 7, an exemplary flow diagram of method 300 for implementing an agitation cycle modifier by washing machine appliance 100 will be described according to an exemplary embodiment of the present subject matter. Notably in method 300, the agitation cycle modifier as discussed above is specifically intended to reduce the production and release of microfiber (MF) particles into washer effluent. Accordingly, the agitation modifier may be referred to as a "Low MF" profile.

According to exemplary embodiments, method 300 may be similar to or interchangeable with method 200 and may be implemented by controller 150 of washing machine appliance 100. As shown, at step 302, controller 150 may start a laundry operation in a washing machine appliance 100. Step 304 may include determining whether the washing machine is powered for operation. For example, this may be achieved by evaluating the power condition of controller 150.

Step 306 inquires if a user has selected a user input cycle. If "no", the method returns to 302 and waits for instruction. If "yes", 306 advances to 308. At 308, the method determines which wash cycle is selected. For example, this may be accomplished at the controller 150 by matching the selected (i.e., target) cycle with wash cycles stored at controller 150.

Step 310 inquires if the target wash cycle requires the low MF profile. As discussed above, wash cycles in the required subset of wash cycles has the agitation cycle modifier included as an essential element and it cannot be removed. If "yes", the method advances to 314 and the option to remove the low MF profile is disabled. The method advances to 316. If step 310 is "no", the method inquires at 312 if the wash cycle is eligible or modifiable, i.e., is the wash cycle included in the modifiable subset 158 of wash cycles. If "yes" the method advances to 316. If "no", the selector 164 at display screen 148 is blocked at 318 and the target wash cycle is operated based on the un-modified agitation cycle profile in a predetermined algorithm at 320.

At 316, embodiments with a display screen display a notification that the agitation cycle modifier (i.e., Low MF) is an available option. At 322, the method queries if the "Low MF" is required or if the user has selected it a s a agitation cycle modifier. If "no", the method advances to 320 and the non-modified target wash cycle is performed. If "yes" the method advances to 324 and the target wash cycle modified by the "Low MF" profile is performed.

At 326, method 300 stops.

FIGS. 6 and 7 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using top load washing machine appliance 100 as an example, it should be appreciated that this method may be applied to the operation of any suitable laundry appliance, such as a front load washing machine appliance.

As explained herein, aspects of the present subject matter are generally directed to an advanced smart dispense system for washing machines appliances. The smart dispense system may introduce detergents or softeners in bulk and the system can dispense detergents according to the wash requirements. The washing machine may be equipped with a sensor that can measure fluid property readings such as turbidity, conductivity, and temperature. The advanced smart dispensing system may obtain conductivity readings of pure water and detergent mixed water. The conductivity reading of pure water may be calculated before dispensing the detergent into the filled water and the conductivity reading of detergent mixed water may be obtained after detergent is dispensed in the water. Both conductivity readings may be compared to determine whether a detergent has been dispensed or not. The same method can be used for monitoring softener dispensing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A washing machine appliance comprising:

a subwasher positioned within a cabinet, the subwasher comprising:

a wash tub;

a wash basket mounted within the wash tub, the wash basket defining a wash chamber configured for receiving a load of laundry articles;

an agitation device positioned within the wash chamber;

a motor mechanically coupled to the agitation device;

a control panel including input selectors; and a controller operably coupled to the motor and the control panel, the controller configured to:

receive a user input selecting a target wash cycle from a plurality of wash cycles, wherein the plurality of wash cycles comprises a subset of modifiable wash cycles and a subset of fixed wash cycles, the target wash cycle comprising an agitation cycle profile;

determine that the target wash cycle is a modifiable wash cycle;

receive a user input selecting an agitation cycle modifier for adjusting the agitation cycle profile of the target wash cycle; and perform the target wash cycle with a modified agitation cycle profile as modified by the agitation cycle modifier, wherein the control panel comprises a display screen including a user input, the controller further configured to:

cause a display of an agitation modification selector at the display screen in response to a user input selecting a target wash cycle included in the subset of modifiable wash cycles of the plurality of wash cycles; and block the display of an agitation modification selector at the display screen in response to a user input selecting a target wash cycle included in the subset of fixed wash cycles of the plurality of wash cycles.

2. The washing machine appliance of claim 1, wherein the agitation cycle profile comprises:

rotation of the agitation device in a first direction at a first speed for a first duration;

a first dwell time;

rotation of the agitation device in a second direction at a second speed for a second duration; and a second dwell time; and wherein the agitation cycle modifier alters one or more of the first speed, the first duration, the first dwell time, the second speed, the second duration, and the second dwell time.

3. The washing machine appliance of claim 2, wherein the agitation cycle modifier reduces the first speed and the second speed.

4. The washing machine appliance of claim 2, wherein the agitation cycle modifier reduces the first duration and the second duration by a total time reduction and increases the first dwell time and the second dwell time by a total time increase corresponding to the total time reduction.

5. The washing machine appliance of claim 1, wherein:

receiving a user input selecting an agitation cycle modifier for adjusting an agitation cycle profile of the target wash cycle comprises user manipulation of the agitation modification selector at the display screen.

6. The washing machine appliance of claim 5, wherein the controller is further configured to cause a display at the display screen confirming a selection of an agitation cycle modifier for the target wash cycle.

7. The washing machine appliance of claim 1, wherein the agitation device comprises at least one of a plurality of ribs extending from the wash basket into the wash chamber and a vane agitator.

8. The washing machine appliance of claim 1, wherein the agitation cycle modifier reduces a duty cycle.

9. The washing machine appliance of claim 1, wherein the subset of modifiable wash cycles comprises a normal cycle, a whites cycle, a towels cycle, a cold wash cycle, a synthetics cycle, and a rinse and spin cycle.

10. A method of operating a washing machine appliance, the washing machine appliance comprising a subwasher positioned within a cabinet, the subwasher comprising a wash tub, a wash basket mounted within the wash tub, the wash basket defining a wash chamber configured for receiving a load of laundry articles, an agitation device positioned within the wash chamber, a motor mechanically coupled to the agitation device, a control panel including input selectors, and a controller operably coupled to the motor and the control panel, the method comprising:

receiving a user input selecting a target wash cycle from a plurality of wash cycles, wherein the plurality of wash cycles comprises a subset of modifiable wash cycles and a subset of fixed wash cycles, the target wash cycle comprising an agitation cycle profile;

determining that the target wash cycle is a modifiable wash cycle;

receiving a user input selecting an agitation cycle modifier for adjusting the agitation cycle profile of the target wash cycle; and performing the target wash cycle with a modified agitation cycle profile as modified by the agitation cycle modifier, wherein the control panel comprises a display screen including a user input, the method further comprising:

causing a display of an agitation modification selector at the display screen in response to a user input selecting a target wash cycle included in the subset of modifiable wash cycles of the plurality of wash cycles; and blocking the display of an agitation modification selector at the display screen in response to a user input selecting a target wash cycle included in the subset of fixed wash cycles of the plurality of wash cycles.

11. The method of claim 10, wherein the agitation cycle profile comprises:

rotation of the agitation device in a first direction at a first speed for a first duration;

a first dwell time;

rotation of the agitation device in a second direction at a second speed for a second duration; and a second dwell time; and wherein the agitation cycle modifier alters one or more of the first speed, the first duration, the first dwell time, the second speed, the second duration, and the second dwell time.

12. The method of claim 11, wherein the agitation cycle modifier reduces the first speed and the second speed.

13. The method of claim 11, wherein the agitation cycle modifier reduces the first duration and second duration by a total time reduction ad increases the first dwell time and the second dwell time by a total time increase corresponding to the total time reduction.

14. The method of claim 10, wherein receiving a user input selecting an agitation cycle modifier for adjusting an agitation cycle profile of the target wash cycle comprises user manipulation of the agitation modification selector.

15. The method of claim 14, wherein the method is further configured to cause a display at the display screen confirming selection of an agitation cycle modifier for the target wash cycle.

16. The method of claim 10, wherein the agitation cycle modifier reduces a duty cycle.

17. The method of claim 10, wherein the subset of modifiable wash cycles comprises a normal cycle, a whites cycle, a towels cycle, a cold wash cycle, a synthetics cycle, and a rinse and spin cycle.

18. The method of claim 10, wherein the subset of fixed wash cycles comprises a quick wash cycle, a bulky cycle, a sanitize cycle, a power clean wash cycle, a self-clean cycle, and a delicates cycle.

* * * * *